US006711927B2

(12) United States Patent
Furuyama et al.

(10) Patent No.: US 6,711,927 B2
(45) Date of Patent: Mar. 30, 2004

(54) BENDING APPARATUS FOR A LONG MATERIAL

(75) Inventors: Tsutomu Furuyama, Yokohama (JP); Yoshihiro Koshita, Yokohama (JP); Mitsushige Kawakubo, Yokohama (JP); Osamu Shinkai, Komaki (JP)

(73) Assignees: NHK Springs Co., Ltd., Aichi (JP); Morita & Company, Aichi (JP)

( * ) Notice: Subject to any disclaimer, the term of this patent is extended or adjusted under 35 U.S.C. 154(b) by 0 days.

(21) Appl. No.: 10/024,483

(22) Filed: Dec. 21, 2001

(65) Prior Publication Data

US 2002/0088265 A1 Jul. 11, 2002

(30) Foreign Application Priority Data

Dec. 25, 2000 (JP) ..... 2000-392613

(51) Int. Cl.[7] ..... B21D 7/024; B21D 11/04

(52) U.S. Cl. ..... 72/217; 72/319; 72/387; 72/388

(58) Field of Search ..... 72/217, 319, 387, 72/388

(56) References Cited

U.S. PATENT DOCUMENTS

| | | | | | |
|---|---|---|---|---|---|
| 3,373,587 | A | * | 3/1968 | Shubin et al. | 72/217 |
| 3,493,016 | A | * | 2/1970 | Ott | 72/388 |
| 3,986,381 | A | * | 10/1976 | Shubin et al. | 72/217 |
| 4,000,636 | A | * | 1/1977 | Shubin et al. | 72/217 |
| 4,665,731 | A | * | 5/1987 | Yagi et al. | 72/388 |
| 4,798,073 | A | * | 1/1989 | Dischler | 72/217 |
| 4,876,877 | A | * | 10/1989 | White | 72/388 |
| 4,890,469 | A | * | 1/1990 | Dischler | 72/217 |
| 5,355,708 | A | * | 10/1994 | Kauffman | 72/217 |
| 5,495,741 | A | * | 3/1996 | Yamada | 72/387 |
| 6,173,599 | B1 | * | 1/2001 | Stepanenko et al. | 72/387 |

FOREIGN PATENT DOCUMENTS

| | | |
|---|---|---|
| DE | 28 53 322 | 12/1978 |
| EP | 0 649 688 A1 | 9/1994 |
| FR | 2 737 674 | 8/1995 |
| GB | 2 177 035 A | 6/1985 |

* cited by examiner

*Primary Examiner*—David B. Jones
(74) *Attorney, Agent, or Firm*—Arent Fox Kintner Plotkin & Kahn, PLLC

(57) ABSTRACT

A bending apparatus for a long material comprises: supporting device for supporting a long material in cantilever fashion at least in a bending direction; bending device which nips the material at an input point apart from the supporting device and is rotated by a predetermined angle so as to bend the material between the supporting device and the input point; driving device for rotating the bending device; feeding device for moving the material toward the bending device and setting a position of the material; and moving device which sets up a separation distance between the supporting device and the bending device prior to bending of the material and allows the supporting device and the bending device to move relatively during the bending of the material.

5 Claims, 5 Drawing Sheets

BENDING APPARATUS FOR A LONG MATERIAL

BACKGROUND OF THE INVENTION

1. Field of the Invention

The present invention relates to a bending apparatus for a long material such as round bars and pipes, and more particularly to technology which enables cold bending of the long material at an arbitrary bending radius without use of any special bending die for hot processing.

2. Description of the Related Art

As an apparatus for bending a long material such as a hollow bar and solid round bar, there is a CNC bender which executes cold bending. Generally, the CNC bender comprises a carriage for moving such a material in the longitudinal direction and positioning it by gripping a rear end thereof, a bending die in which a groove having a slightly larger bending radius than the material is formed in the outer periphery and a clamp having a groove similar to the bending die and holding the material in cooperation with the bending die. In this CNC bender, by moving the clamp along the outer periphery of the bending die, the material is drawn into the groove and bent. Next, the carriage is forwarded and by rotating the material as required, next bending operation is carried out.

Because in the aforementioned CNC bender, the bending radius of the material is determined by the bending radius of the bending die, the kinds of the bending radii are restricted. Further, because a head portion comprised of the bending die, the clamp and the like is large, a trace of a bent material may interfere with the head portion or other attached equipment, thereby possibly restricting a bending processing shape.

Because the CNC bender has the above-described restriction, hot-bending by use of a dedicated total bending die for each product is a main stream for, for example, a solid stabilizer. However, the dedicated total bending die is quite expensive and production cost is relatively high if a bending die is prepared for even a product having a small production amount. Further, because spare parts need to be supplied still even after production thereof is stopped, its special bending die needs to be stored for a long period, so that a large amount of space is required. Further, in case of producing a prototype which cannot be cold-processed with the CNC bender, a skilled worker corresponds to this demand by partially heating the material and manually bending it. Therefore, there is such a problem that due date required by a customer cannot be satisfied sufficiently.

SUMMARY OF THE INVENTION

Accordingly, an object of the present invention is to provide a bending apparatus for a long material capable of cold-bending material at an arbitrary curvature radius and bending angle without using any special bending die.

To achieve the above object, the present invention provides a bending apparatus for a long material comprising: supporting device for supporting a long material in cantilever fashion at least in a bending direction; bending device which nips the material at an input point apart from the supporting device and is rotated by a predetermined angle so as to bend the material between the supporting device and the input point; driving device for rotating the bending device; feeding device for moving the material toward the bending device and setting a position of the material; and moving device which sets up a separation distance between the supporting device and the bending device prior to bending of the material and allows the supporting device and the bending device to move relatively during the bending of the material.

The operation of the present invention will be described with reference to FIGS. 1, 2. If the bending device 2 is rotated by an angle $\phi$ at an input point B, a uniform moment is applied to the material W supported by the supporting device 1 between the input point B and a supporting point A, so that the material W is bent by the angle $\phi$ with a predetermined curvature radius. In this case, the curvature radius of the material W can be set up by setting a separation distance S between the input point B and the supporting point A appropriately. That is to say, according to the present invention, the material W can be bent at an arbitrary curvature radius and bending angle without using any special bending die. Further, by rotating the bending device in a direction opposite to that shown in FIG. 1, the material can be bent inversely, thereby making it possible to prevent an interference between the material W and the bending apparatus or other attached equipment.

After bending processing at one position is finished, the material W is fed toward the bending device by the feeding device and next bending is started. At this time, the moving device moves any one or both of the supporting device 1 and the bending device 2 so as to set up a separation distance S. FIG. 1 shows an example in which the supporting device is fixed on an apparatus main body while the moving device 3 moves the bending device. In this case, the moving device 3 is an arm which is movable in the lateral direction in the FIG. 1 with respect to the supporting device 1 and rotatable around an end portion opposite to the bending device 2.

FIG. 2 shows an example in which the bending device 2 is fixed on the apparatus main body while the moving device is capable of moving the supporting device 1. The moving device 3 is an arm which can approach or leave the bending device 2 and is rotated around an end portion opposite to the bending device 2. With such a structure, when the bending device 2 is rotated, the moving device 3 is moved following the bending of the material W.

In FIG. 1, the moving device 3 can be provided with driving device. For example, by disposing hydraulic cylinders on both sides of the moving device 3 and coupling a piston of the hydraulic cylinder to an outer periphery of the bending device 2 according to an appropriate method, reciprocating motion of the piston can be converted to a rotating motion of the bending device 2. Alternatively, it is permissible to provide the moving device 3 with a rotation driving mechanism such as a hydraulic motor and further provide this rotation driving mechanism with the bending device 2. However, in this case, a reaction force of moment applied to the bending device 2 is applied to a rotation center P of the moving device 3. Consequently, an additional moment is applied to the material W so that the bending radius is not uniform at respective points of the material. This additional moment in FIG. 1 is analyzed as follows.

Assume that a reaction force applied to the rotation center P of the moving device 3 in FIG. 3 is F and moment given to the material W by the bending device is $M_w$. This moment $M_w$ is a moment acting equally on respective points of the material. About balance of moment around the point B, which is applied to the moving device in FIG. 3, the following formula is established.

$$F^*L_1=M \tag{1}$$

About balance of moment around the point B acting on the material, the following formula is established.

$$F*L_2+M_w=M \quad (2)$$

Here, M in the formula indicates a decay moment inherent of the material and is provided schematically with the following formula.

$$M=d^3*\sigma/6 \quad (3)$$

d: material diameter
σ: stress at yield

According to the formula (2), moment of $F*L_2$ as well as moment $M_w$ by the bending device is applied to the material. If the length $L_1$ of the moving device is set long, according to the formula (1), F decreases inversely proportionally. Thus, the term of $F*L_2$ in the formula (2) decreases. Therefore, by prolonging the length of the moving device sufficiently, moment applied to the material is substantially equalized, thereby making the bending radius substantially uniform.

When the driving device for rotating the bending device 2 is separated dynamically from the moving device 3, F equals 0 in the formulas (1) and (2), and $M_w$ equals M. That is, it is preferable since the moment in overall the bending area S is uniform. For example, in the example shown in FIG. 1, it is permissible to fix the driving device to the apparatus main body and couple the driving device with the bending device 2 by device of a joint such as universal joint. In contrast, when the example shown in FIG. 2 is dynamically analyzed, although the moment in overall the bending area S cannot be completely uniform, but can be approximately uniform by setting up the length $L_1$ of the moving device sufficiently large. Therefore, in this case also, it is desirable to set up the length of the moving device sufficiently large.

Preferably, any one or both of the supporting device and the bending device has gripping device for gripping detachably the material with inner peripheral faces thereof having a configuration fitting to outer peripheral faces of the material. With such a structure, it is possible to suppress flattening or occurrence of pressure mark which may occur when the material is bent. Further, preferably, the feeding device includes rotating device for rotating the material around its axis in the longitudinal direction and setting an angular position. By rotating the material while feeding it, a three-dimensional product can be processed. Meanwhile, although the present invention is suitable for cold bending processing of a solid stabilizer, the present invention is not restricted to the manufacturing of such a product. Further, the material for use is not restricted to a round bar, but may be applied to material having an arbitrary cross section such as H-shaped channel and C-shape/L-shaped channel.

BRIEF DESCRIPTION OF THE DRAWINGS

FIG. 2A is a plan view showing a condition in which material is being bent for explaining operation of the present invention, while

DESCRIPTION OF THE PREFERRED EMBODIMENTS

1. First embodiment

A. Structure of the First Embodiment

Figure 1:
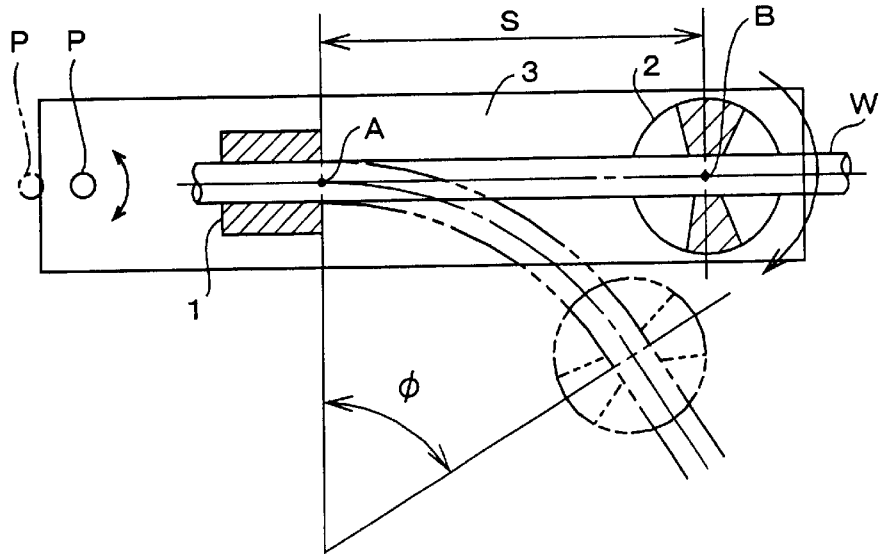
FIG. 1 is a plan view showing a condition in which material is being bent for explaining operation of the present invention.
Figure 2A:
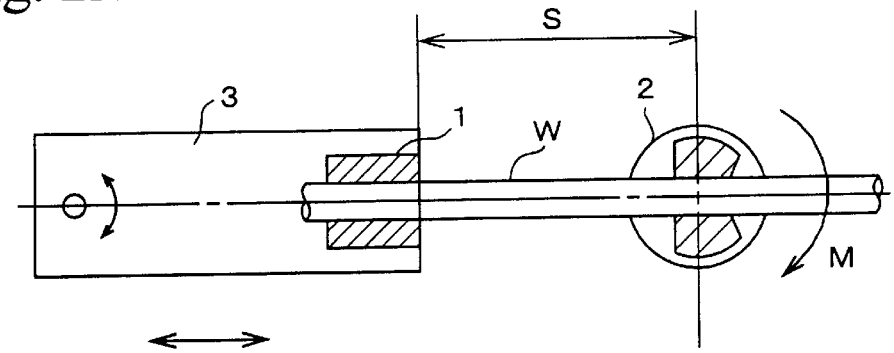
Figure 2B:
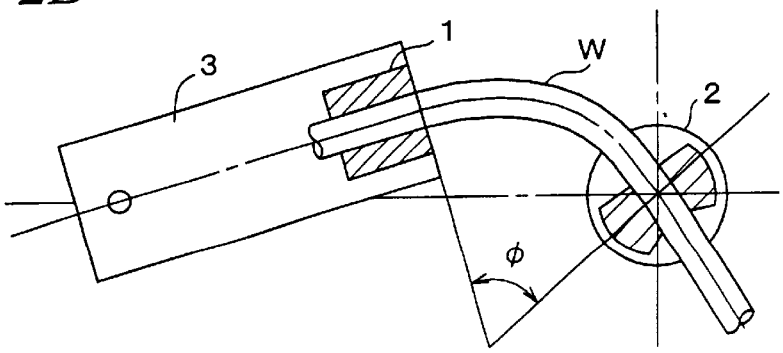
FIG. 2B is a plan view showing a condition in which material has been bent from the condition shown in (A)
Figure 3:
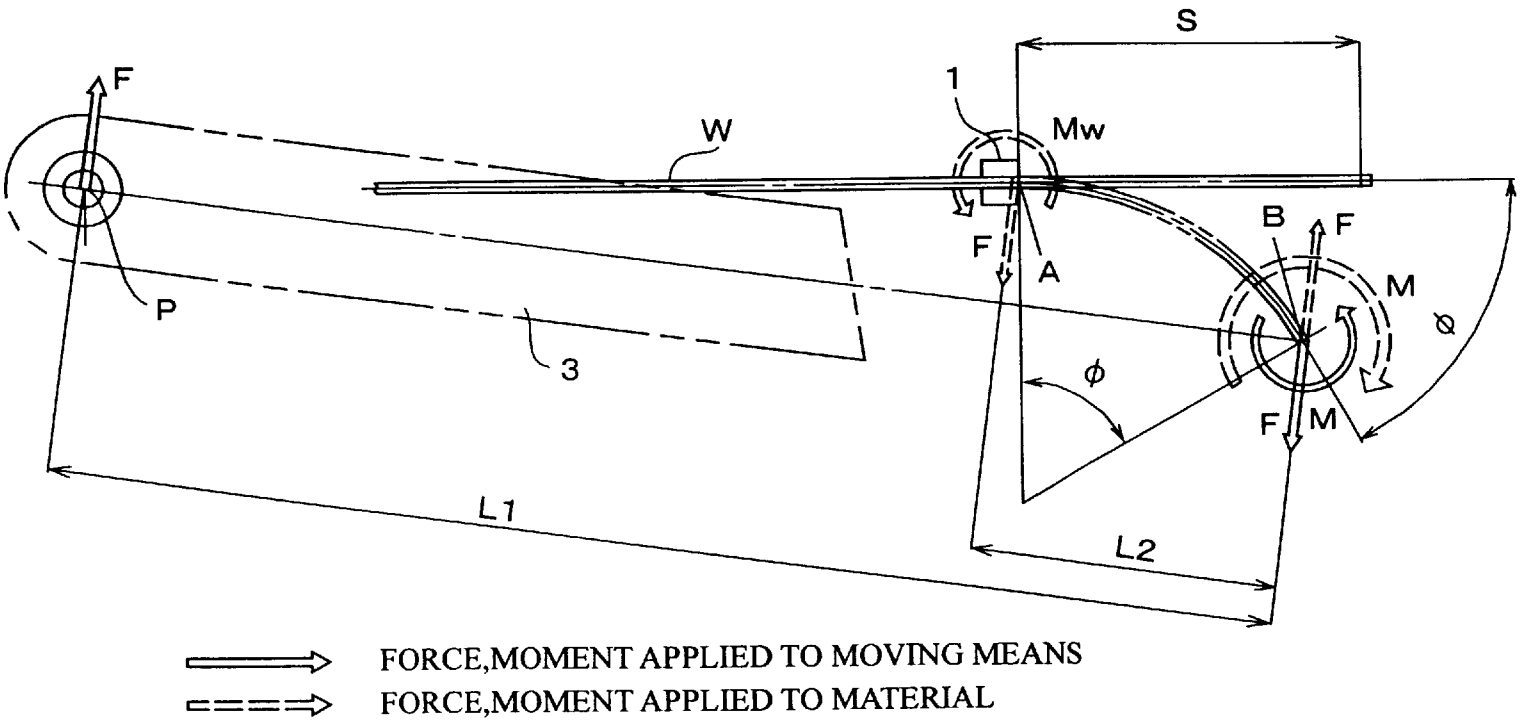
FIG. 3 is a plan view showing a bending apparatus according to the first embodiment of the present invention.
Figure 4:
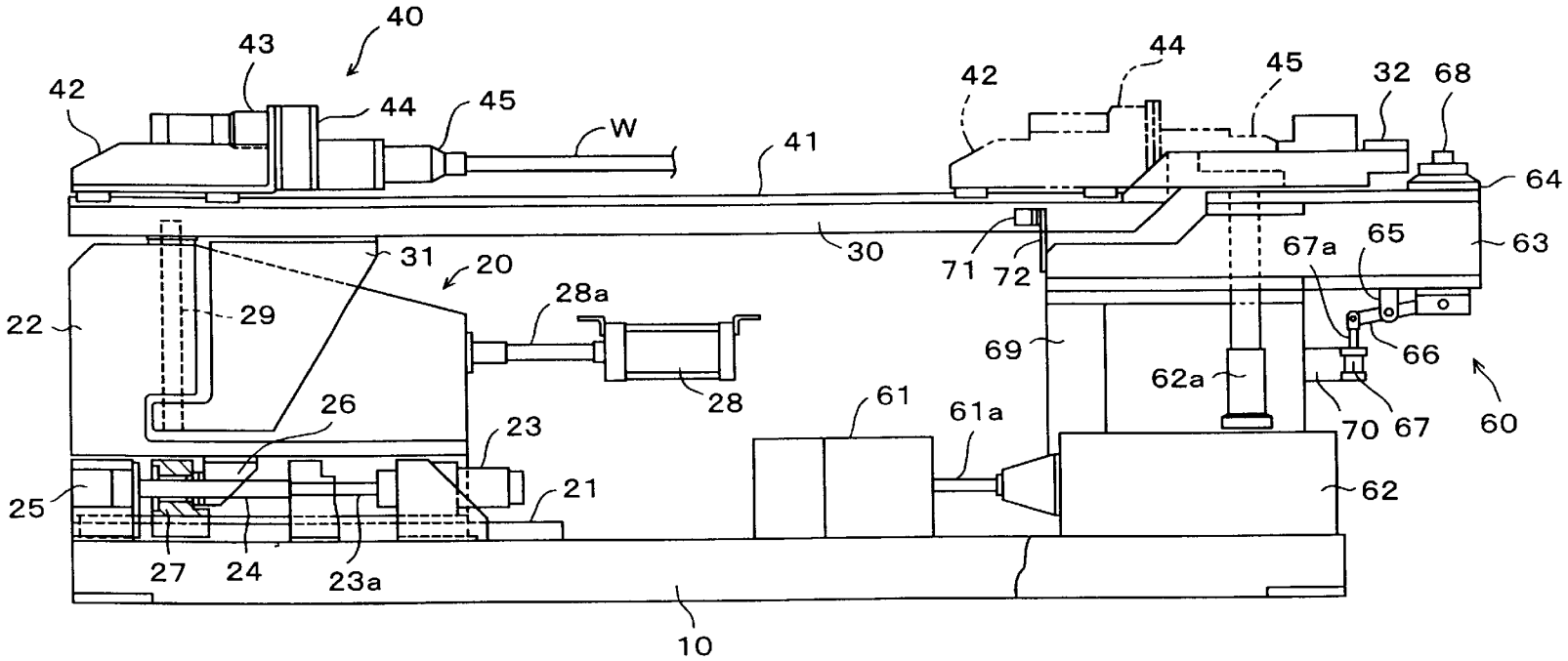
FIG. 4 is a side view showing a bending apparatus of the first embodiment of the present invention.
Figure 5:
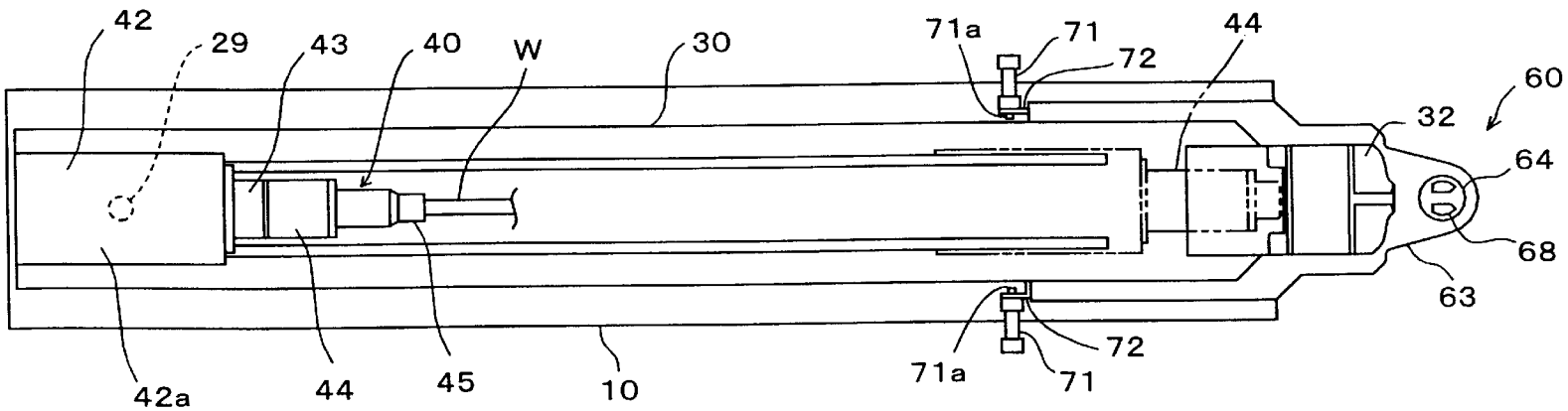
FIG. 5 is a plan view showing a bending apparatus of the first embodiment of the present invention.

Hereinafter, the preferred embodiments of the present invention will be described with reference to FIGS. 4, 5. The bending apparatus of this embodiment comprises an arm positioning mechanism (moving device) 20, a material feeding mechanism (feeding device) 40 and a bending head portion (bending device) 60, these components being mounted on a frame 10. The structure of these components will be described below. Reference numeral 21 in the Figure indicates a guide rail and a slide frame 22 is supported slidably in the lateral direction in FIG. 4. A motor 23 is provided on the frame 10 with its output shaft 23*a* directed horizontally. An end portion of a ball screw 24 is coupled to an output shaft 23*a* of the motor 23 while the other end portion of the ball screw 24 is supported rotatably by a bearing 25 mounted on the frame 10.

Reference numeral 27 in the same Figure denotes a movable stopper, which is supported slidably by a guide rail 21. A ball screw (female screw) is provided in the movable stopper 27 such that it engages a ball screw 24. If the ball screw 24 rotates, the movable stopper 27 is reciprocated linearly along the guide rail 21. The movable stopper 27 is a separate component which can be detached from the bracket 26 and has a function as a stopper for positioning the bracket 26.

An air cylinder 28 is mounted on the frame 10 while an end portion of its piston 28*a* is pressed against a slide frame 22. This air cylinder 28 presses the bracket 26 against the movable stopper 27 when the motor 23 rotates to move the slide frame 22. That is to say, the air cylinder 28 has a function of stabilizing stop of the slide frame 22 so as to improve its positioning accuracy.

A shaft 29 whose axis line is directed vertically is supported rotatably on the slide frame 22. An upper end portion of the shaft 29 is protruded from the slide frame 22 and a proximal end portion of the arm 30 is fixed to that upper end portion of the shaft 29. Meanwhile, reference numeral 31 in the same Figure denotes a rib supporting the arm such that it is directed upward. An end portion of the arm 30 reaches over the bending head portion 60 while a damper (supporting device) 32 is provided on an upper face thereof. The damper 32 can be opened or closed and a groove (not shown) having a curvature radius slightly larger than that of a round bar which is a material W is formed in an inner peripheral face of the damper 32.

Next, the material feeding mechanism 40 will be described. A guide rail 41 is provided on an upper face of the arm 30 and a carriage 42 is supported slidably in a lateral direction with respect to FIG. 4 by the guide rail. A motor (rotating device) 43 is provided on the carriage 42 and the motor 43 rotates a chuck 45 which can be opened/closed via a reducer 44. Although not shown, the arm 30 or the carriage 42 is provided with a motor and further an appropriate power transmitting device such as ball screw/ball nut mechanism, a timing chain and timing belt. By such a mechanism, the carriage 42 can be moved on the guide rail 41. Reference numeral 42*a* in FIG. 5 denotes a cover of the carriage 42 and FIG. 4 indicates a condition in which the cover 42*a* is removed.

Next, the bending head portion 60 will be described. A motor (driving device) 61 is mounted on the frame 10. An output shaft 61*a* of the motor 61 is coupled to a reducer 62. An output shaft 62*a* of the reducer 62 is protruded upward and an upper end portion thereof is inserted into the head 63. A bending jig 64 is supported slidably and rotatably in a vertical direction at an end portion of the head 63. An intermediate portion in the vertical direction of the bending jig 64 is connected to the output shaft 62*a* of the reducer 62 through an appropriate transmitting mechanism such as a timing chain. A bottom end portion protruded from the head 63 of the bending jig 64 is connected to an upper portion thereof such that it is relatively rotatable. An end portion of a lever 66 whose central portion is supported rotatably by a bracket 65 is mounted rotatably on the bottom end portion of the bending jig 64. The other end portion of the lever 66 is attached rotatably to a piston 67*a* of a hydraulic cylinder 67.

A pair of bending blocks 68 are mounted on an upper end face of the bending jig 64. The bending blocks 68 are separated from each other at an interval slightly larger than the diameter of material W. Although according to this embodiment, the bending blocks 68 are fixed, it is preferable to form them so that they can be opened/closed like the aforementioned damper 32. In this case, a groove having a slightly larger curvature radius than the material W is formed in an inner peripheral face thereof. Reference numeral 69 denotes a stand, which fastens the head 63 to the frame 10. Reference numeral 70 denotes a bracket, which fastens the hydraulic cylinder 67 to the stand 69.

Next, a pair of hydraulic or pneumatic piston cylinders 71 are mounted via a bracket 72 on a rear end portion of the head 63. The piston cylinder 71 presses side faces of the arm 30 equally by device of its piston 71*a* so as to adjust the arm tilted after the material W is bent to a straight position.

B. Operation of the first embodiment

Next, the operation of the bending apparatus having the above-described structure will be described.

A rear end portion of the material W is set to the chuck 45 of the material feeding mechanism 40 and a predetermined switch of a control panel (not shown) is turned on. Then, the chuck 45 grips the material W and the slide frame 22 moves so that an interval between the damper 32 and the bending block 68 becomes a distance set up to a first bending processing. Because at that time, the valve of the air cylinder 28 is closed, the slide frame 22 moves resisting a urging force of the piston 28*a*. Consequently, the stop of the slide frame 22 is stabilized so as to improve the positioning accuracy. Further, the carriage 42 moves so as to forward the material W up to the first bending position. The moving amount of the carriage 42 is corrected by adding a moving amount of the slide frame 22.

If the carriage 42 is forwarded, the material W is inserted into a gap in the damper 32 and a gap in the bending block 68. If the material W is long, when the material W is set up in the chuck 45, the material W may reach the damper 32 or the bending block 68. Next, the damper 32 is closed to grip the material W and then, the bending jig 64 is rotated by an angle set as a first bending angle. Consequently, a substantially uniform moment is applied to the material W between the damper 32 and the bending block 68, so that that corresponding portion is bent at the set curvature radius. At that time, the valve of the air cylinder 28 is opened so as to leave the slide frame 22 slidable. The arm 30 is rotated around the shaft 29 following a bending of the material W and simultaneously moves forward.

Next, the piston 67*a* of the hydraulic cylinder 67 is stretched so that the bending jig 64 descends and then, the bending block 68 is released from the material W. Consequently, the arm 30 is made rotatable with respect to the shaft 29. Then, the piston cylinders 71 are actuated so that the pistons 71*a* are stretched to press the side faces of the arm 30 equally. As a result, the arm 30 is positioned to a straight status relative to the bending jig 64. Next, the slide frame 22 moves, so that an interval between the damper 32 and the bending jig 68 becomes the distance set for a second bending processing. In order to forward the slide frame 22 from its original position, the movable stopper 27 is forwarded and at that time, by throttling the valve of the air cylinder 28, the bracket 26 is pressed against the movable stopper 27. In order to retreat the slide frame 22, the movable stopper 27 is retreated and the piston 28*a* of the air cylinder 28 is stretched so as to press back the bracket 26. Next, the damper 32 is opened and the carriage 42 is forwarded to the second bending position so as to feed the material W and rotate the material W at a set angle.

Next, the damper 32 is closed to grip the material W. At this time, the bending jig 64 is already rotated inversely and returned to its original angular position. Next, the bending jig 64 is raised so that the bending block 68 nips the material W. The bending jig 64 is rotated by an angle set as the second bending angle. After the material W is bent by a set frequency in this manner, the bending apparatus is stopped. Then, the chuck 45 and the damper 32 are opened by operating a predetermined switch on the control panel and the bent material W is taken out.

The bending apparatus having the above described structure is capable of bending the material W at an arbitrary curvature radius and an arbitrary bending radius without using any special bending die. Because the material W can be bent even if the bending jig 64 is rotated in any direction, it is possible to prevent an interference between the material W and the bending apparatus or other attached equipment. Particularly in the above-described embodiment, the arm positioning mechanism 20 and the bending head portion 60 are separated and a reaction force to a moment generated in the shaft 29 (rotation fulcrum point of the arm 30) when the material W is bent is small. Further, because the length of the arm 30 is set sufficiently large, the reaction force generated in the shaft 29 is very small and a stress generated in the material W becomes substantially equal, thereby making it possible to obtain an equal curvature radius. Because the inner face of the damper 32 is formed in a configuration fitting to the outer periphery of the material W, it is possible to suppress flattening and generation of a pressure mark which may occur when the material W is bent, by forming the inner face of the bending block 68 in such a configuration.

2. Second Embodiment

Figure 6:
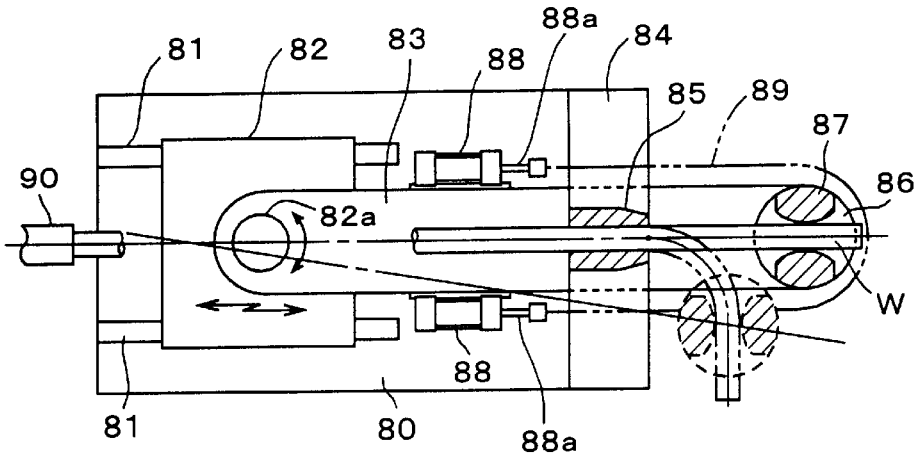
FIG. 6 is a plan view showing a bending apparatus of a second embodiment.
Figure 7:
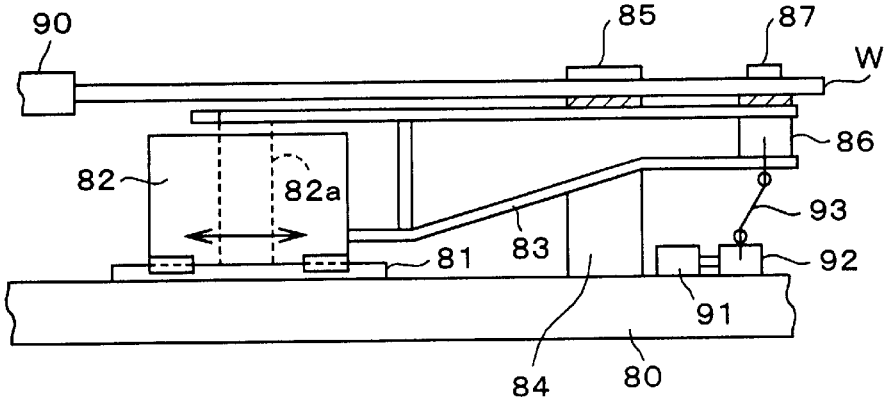
FIG. 7 is a side view showing a bending apparatus of the second embodiment of the present invention.

Next, the second embodiment of the present invention will be described with reference to FIGS. 6, 7. Reference numeral 80 in the same Figure denotes a frame and guide rails 81 are mounted on a top face of the frame 80. A slide frame (moving device) 82 is supported slidably by the guide rails 81. Although not shown, the slide frame 82 is moved by a similar motor, ball screw and ball nut to the first embodiment and supplied with a resistance during moving by an air cylinder. A rear end portion of the arm 83 is supported by the slide frame 82 rotatably. A front end portion of the arm 83 is fixed to the frame 80 such that a gate type frame 84 rides over an arm 83. A supporting block (supporting device) 85 is mounted on a top face of the gate type frame 84.

A bending jig 86 is mounted on a top face of the front end portion of the arm 83 and a bending block 87 is provided on a top face of the bending jig 86. Although not shown, the bending jig 86 is slidable vertically due to the same structure as the first embodiment. A hydraulic cylinder (driving device) 88 is mounted on each of both side faces of the arm 83. Both end portions of a timing chain 89 are coupled to the pistons 88*a* of the hydraulic cylinder 88. The timing chain 89 is wound such that it engages a sprocket (not shown) protruded from an outer periphery of the bending jig 86. Reference numeral 90 in the same Figure denotes material feeding mechanism, which grips a rear end portion of the material W and feeds it in the axial direction and rotates it.

Next, the operation of the bending apparatus of the second embodiment will be described.

A rear end portion of the material W is gripped by the material feeding mechanism 90 and a predetermined switch of the control panel (not shown) is turned on. Consequently, the slide frame 82 is moved so that an interval between the supporting block 85 and the bending block 87 becomes a distance set for the first bending processing. At the same time, the material feeding mechanism 90 is forwarded up to a first bending position.

If the material feeding mechanism 90 is forwarded, the material W is inserted into a gap in the supporting block 85 and a gap in the bending block 87. Next, the hydraulic cylinder 88 is actuated and the bending jig 86 is rotated by an angle set as the first bending angle. As a result, a moment is applied to the material W in the gaps of the block 85 and the bending block 87 so that that corresponding portion is bent. At that time, the arm 83 is left slidable and rotatable, so that the arm 83 is moved following a bend of the material W.

Next, the bending jig 86 descends so that the bending block 87 is released from the material W. With this condition, the slide frame 82 is moved and consequently, the interval between the supporting block 85 and the bending block 87 becomes the distance set for the second bending processing. The material feeding mechanism 90 forwards the material W up to a second bending position and rotates the material W by a set angle. Next, the bending jig 86 is rotated inversely and returned to its original angular position and raised so that the bending block 87 nips the material W. The bending jig 86 is rotated by an angle set as the second bending angle by operation of the hydraulic cylinder 88. A set number of bending processings are carried out to the material W and then, the processing is completed.

With the bending apparatus having the above-described structure, substantially the same operation and effect as the first embodiment can be obtained. Because a winding drive source of the bending jig 86 is mounted on the arm 83, a reaction force of a moment given to the material W by the bending jig 86 is applied to the shaft 82*a*. As a result, an additional moment is applied to the material W so that the material W is not bent entirely at an equal curvature radius. Thus, it is recommendable to so construct that a rotation of the motor 91 is transmitted to the bending jig 86 through a reducer 92 or a universal joint 93 instead of the hydraulic cylinder 88 as shown in FIG. 7. Despite the structure shown in FIG. 6, changes of the curvature radius can be made negligible by increasing the distance between the shaft 82*a* and the supporting block 85 sufficiently.

3. Variations of the Embodiments

The present invention is not restricted to the above described embodiments but may be modified in the following various ways.

(1) By setting a moving distance of the slide frame 82 sufficiently long in the second embodiment, it can be provided with a function of the material feeding mechanism 90 at the same time. That is to say, instead of the material feeding mechanism 90, a stand for supporting material is disposed and the supporting block 85 and the bending block 87 are so constructed as dampers which can be opened/closed. By bringing a rear end portion of the material into contact with the stopper of the stand, the material is positioned and a front end portion of the material is gripped by the bending block 87. Next, after the material is set on a first bending position by forwarding the slide frame 82, the material is clamped with the supporting block 85 and at the same time, the bending block 87 is opened. By retreating the slide frame 82, the bending block 87 is set on the first bending position and rotated so as to bend the material. Such a structure can be applied to the first embodiment also.

(2) The first embodiment may be so constructed that the bending jig 64 can be rotated by using a hydraulic cylinder.

What is claimed is:

1. A bending apparatus for an elongated material comprising:

a supporting device for holding the elongated material in a cantilever fashion so as not to slide the elongated material in a longitudinal direction thereof;

a bending device which nips the material at an input point apart from the supporting device and is rotated by a predetermined angle so as to bend the material between the supporting device and the input point;

a driving device for rotating the bending device;

a feeding device for moving the material toward the bending device and setting a position of the material; and a moving device which sets up a separation distance between the supporting device and the bending device prior to bending of the material and allows the supporting device and the bending device to move relatively during the bending of the material.

2. The bending apparatus as claimed in claim 1, wherein the feeding device includes a rotating device for rotating the material around its axis in the longitudinal direction and setting an angular position.

3. The bending apparatus as claimed in claim 1, wherein at least any one of the supporting device and the bending device has a gripping device for gripping detachably the material with inner peripheral faces thereof, the inner peripheral faces have a configuration fitting to an outer peripheral face of the material.

4. The bending apparatus as claimed in claim 1, wherein position of the bending device is not varied, and the moving device supports the supporting device such that the supporting device moves according to transformation of the material when the bending device is bending the material.

5. The bending apparatus as claimed in claim 1, wherein position of the supporting device is not varied, and the moving device supports the bending device such that the bending device moves according to transformation of the material when the bending device is bending the material.

* * * * *

UNITED STATES PATENT AND TRADEMARK OFFICE

CERTIFICATE OF CORRECTION

PATENT NO. : 6,711,927 B2
DATED : March 30, 2004
INVENTOR(S) : Furuyama et al.

It is certified that error appears in the above-identified patent and that said Letters Patent is hereby corrected as shown below:

Title page,
Item [73], Assignee, please change the first Assignee to read:

-- NHK Spring Co., Ltd., Kanagawa (JP) --.

Signed and Sealed this

Sixteenth Day of November, 2004

JON W. DUDAS
*Director of the United States Patent and Trademark Office*